US005767055A

United States Patent [19]

Choy et al.

[11] Patent Number: 5,767,055

[45] Date of Patent: Jun. 16, 1998

[54] APPARATUS FOR SURFACE CLEANING

[75] Inventors: Clement K. Choy, Alamo; Michael H. Robbins, Pleasanton, both of Calif.

[73] Assignee: The Clorox Company, Oakland, Calif.

[21] Appl. No.: 605,824

[22] Filed: Feb. 23, 1996

[51] Int. Cl.[6] ..... C11D 17/04

[52] U.S. Cl. ..... 510/406; 510/108; 510/238; 510/370; 510/379; 510/380; 510/439; 510/480; 252/186.26; 252/186.27

[58] Field of Search ..... 510/438, 380, 510/108, 379, 439, 370, 238, 406, 480; 252/187.24, 187.26, 187.27

[56] References Cited

U.S. PATENT DOCUMENTS

| | | | |
|---|---|---|---|
| 3,660,295 | 4/1970 | LaBarge et al. . | |
| 3,741,903 | 6/1973 | Evans . | |
| 3,760,986 | 9/1973 | Castner et al. . | |
| 4,025,453 | 5/1977 | Kravetz et al. | 252/102 |
| 4,029,607 | 6/1977 | Murtaugh | 252/545 |
| 4,060,600 | 11/1977 | Vit . | |
| 4,124,542 | 11/1978 | Devine . | |
| 4,127,496 | 11/1978 | Stokes . | |
| 4,151,104 | 4/1979 | Alvarez et al. . | |
| 4,155,738 | 5/1979 | Boghosian . | |
| 4,155,871 | 5/1979 | Donaldson . | |
| 4,207,215 | 6/1980 | Bolan | 252/542 |
| 4,367,155 | 1/1983 | Birkelo . | |
| 4,377,489 | 3/1983 | King | 252/99 |
| 4,431,558 | 2/1984 | Ulrich . | |
| 4,530,781 | 7/1985 | Gipp . | |
| 4,541,945 | 9/1985 | Anderson et al. | 252/149 |
| 4,556,504 | 12/1985 | Rek | 510/340 |
| 4,595,527 | 6/1986 | Gipp . | |
| 4,629,570 | 12/1986 | Kennedy, Jr. | 210/666 |
| 4,636,328 | 1/1987 | Flynn et al. . | |
| 4,663,082 | 5/1987 | Bobsein et al. | 252/530 |
| 4,690,772 | 9/1987 | Tell et al. | 510/370 |
| 4,720,351 | 1/1988 | Flynn et al. . | |
| 4,749,509 | 6/1988 | Kacher . | |
| 4,749,516 | 6/1988 | Brusky . | |
| 4,772,414 | 9/1988 | Marzec et al. . | |
| 4,776,972 | 10/1988 | Barrett . | |
| 4,810,421 | 3/1989 | Marchesini . | |
| 4,835,804 | 6/1989 | Arnau-Munoz et al. . | |
| 4,878,951 | 11/1989 | Pochard et al. . | |
| 4,898,681 | 2/1990 | Burton . | |
| 4,908,215 | 3/1990 | Perlman . | |
| 4,944,892 | 7/1990 | Leathers et al. | 510/370 |

(List continued on next page.)

FOREIGN PATENT DOCUMENTS

| | | |
|---|---|---|
| 0008475 | 12/1981 | European Pat. Off. . |
| 598973A1 | 6/1994 | European Pat. Off. . |
| 616028A1 | 9/1994 | European Pat. Off. . |
| 0696807 | 2/1996 | European Pat. Off. . |
| 5-70799 | 3/1993 | Japan . |
| 2545654 | 8/1996 | Japan . |
| 2234981 | 2/1991 | United Kingdom . |
| 94/10272 | 5/1994 | WIPO . |
| 95/02390 | 1/1995 | WIPO . |
| 95/16023 | 6/1995 | WIPO . |
| 96/06912 | 3/1996 | WIPO . |

*Primary Examiner*—Douglas J. McGinty
*Assistant Examiner*—Lorna M. Douyon
*Attorney, Agent, or Firm*—Majestic, Parsons, Siebert & Hsue

[57] ABSTRACT

An apparatus for surface cleaning is provided in which a first liquid, which includes an oxidizing agent, and a second liquid, which includes a builder or a chelating agent, are initially maintained separately. The apparatus is constructed to facilitate delivery of these two liquids such that they are combined to form an admixture during delivery to a surface to be treated. Either or both of the first and second liquids include a pH-adjusting agent, which is present in an amount such that when the liquids are so delivered, the resulting admixture is maintained at a pH sufficient for cleaning efficacy and stability of the oxidizing agent. The present invention also provides a composition produced by a process of maintaining the two above-mentioned liquids separately and forming an admixture thereof during delivery to a surface to be treated.

20 Claims, 6 Drawing Sheets

U.S. PATENT DOCUMENTS 5,152,461 10/1992 Proctor ..... 239/304
5,185,096 2/1993 Ahmed .
5,252,245 10/1993 Garabedian, Jr. et al. ..... 252/153
5,273,678 12/1993 Deroux et al. .
5,340,501 8/1994 Steindorf ..... 252/546
5,437,807 8/1995 Garabedian, Jr. et al. ..... 252/153
5,454,984 10/1995 Graubart et al. ..... 252/547
5,468,423 11/1995 Garabedian, Jr. et al. ..... 252/546
5,492,540 2/1996 Leifheit et al. .
5,587,025 12/1996 Jevec et al. ..... 148/274

APPARATUS FOR SURFACE CLEANING

FIELD OF THE INVENTION

The present invention relates generally to a bleaching or cleaning composition and more particularly to a liquid composition which includes an oxidizing agent and is useful for treating surfaces. The present invention also relates to an apparatus for delivery of the composition.

BACKGROUND OF THE INVENTION

Liquid cleaning compositions which include an oxidizing agent for bleaching or cleaning a discolored or unclean surface are known. See Birkelo, U.S. Pat. No. 4,367,155, filed May 7, 1981 and issued Jan. 4, 1983. Such liquid cleaning compositions are typically prepared by combining the oxidizing agent and the remaining ingredients of the cleaner and mixing or blending the combination to form a homogeneous composition appropriate for application to the surface to be treated.

However, most of the liquid cleaners prepared in this manner have proved to be deficient in terms of the stability or the bleaching or cleaning efficacy of the oxidizing agent. For example, Birkelo (above) discloses that its blended composition, which includes a hypochlorite salt solution, is stable for only a limited period of time, such that virtually immediate use of the blend is desired for maximum brightening efficacy.

Attempts have been made to address the lack of cleaning efficacy or stability of the oxidizing agent in specific liquid cleaners. For example, Alvarez et al., in U.S. Pat. No. 4,151,104, filed Feb. 6, 1978 and issued Apr. 24, 1979, recognize the problem of hypochlorite decomposition in conventional liquid hypochlorite bleaches and the resulting undesirable loss of the oxidizing power of these bleaches during their shelf life. Alvarez et al. teach a hypochlorite bleaching composition used for laundry applications, which includes an alkali metal orthophosphate buffer and an alkali metal pyrophosphate builder.

In U.S. Pat. No. 4,908,215, filed Nov. 21, 1988 and issued Mar. 13, 1990, Perlman discusses the problem of rapid hypochlorite destruction in liquid cleaners in which hypochlorite and thiosulfate are combined and allowed to react. Perlman discloses a liquid cleanser including hypochlorite, thiosulfate, and a "pre-buffer" which is initially inactive, wherein the hypochlorite and thiosulfate react until the pH falls to a value near the pKa of the pre-buffer and substantially below the initial pH of the cleaner, whereupon the pre-buffer becomes a buffer. A pH buffer is not included in Perlman's initial reaction solution, as Perlman states that maintaining a constant pH throughout the thiosulfate-hypochlorite reaction process is disadvantageous.

Additionally, in U.S. Pat. No. 4,898,681, filed Aug. 31, 1988 and issued Feb. 6, 1990, Burton discusses the problem of hypochlorite decomposition during storage of dilute hypochlorite bleaches (as opposed to full strength household bleaches), which are used as laboratory disinfectants. These dilute hypochlorite bleaches are said to be prone to rapid loss of strength and thus, practically require daily preparation.

Burton teaches a disinfectant formulation of dilute aqueous sodium hypochlorite and a small proportion of calcium disodium ethylenediaminetetraacetic acid which is said to stabilize the dilute sodium hypochlorite component against decomposition during storage. Burton states that this stabilizing action is apparently unique to calcium disodium ethylenediaminetetraacetic acid, and not shared by other chelants closely related chemically. Burton further states that the calcium disodium ethylenediamine-tetraacetic acid is unique in that it is not degraded during storage by the strong oxidizing action of the sodium hypochlorite, which degrades most available chelating agents and thus, renders them ineffective for improving hypochlorite stability.

As to a liquid bleaching composition for laundering applications, La Barge et al. disclose that the components of their bleaching composition, which become unstable upon normal interaction, may be separately contained in a multi-chambered package from which they are poured prior to mixing in the presence of water to form a bleaching bath. La Barge et al., U.S. Pat. No. 3,660,295, filed Apr. 27, 1970 and issued May 2, 1972. In another laundering application, Arnau-Munoz et al. disclose a container having compartments which separately receive the mutually incompatible constituents of a detergent composition, such as constituents which release active oxygen or chlorine and constituents which make up the remainder of the detergent composition. Arnau-Munoz et al., U.S. Pat. No. 4,835,804, filed Mar. 25, 1988 and issued Jun. 6, 1989. Each of the compartments has openings which permit diffusion of its contents into a washing machine during the washing process.

The prior art fails to provide an effective means of delivering a liquid cleaner, including any of a variety of possible oxidizing agents, such that the oxidizing agent thereof is stable and effective as a bleaching or cleaning agent when so delivered to a surface to be treated.

SUMMARY OF THE INVENTION

It is an object of the present invention to provide a bleaching or cleaning composition which includes an oxidizing agent, wherein the composition provides an environment appropriate for maintaining cleaning efficacy or stability of the oxidizing agent.

It is a further object of the invention to provide an apparatus for convenient and effective delivery of such a composition to a surface to be treated.

These and other objects are achieved by the present invention which provides a bleaching or cleaning composition which includes an oxidizing agent, wherein the composition provides an environment sufficient for maintaining a cleaning efficacy or stability of the oxidizing agent upon delivery to a surface to be treated. The composition is produced in such a way that the cleaning efficacy or stability of the oxidizing agent is effectively maintained prior to use, such as during storage, as well as upon use, such as upon spraying or other delivery of the composition to a surface to be treated.

More specifically, the composition is a product of two liquids which are separately maintained prior to forming an admixture during delivery to a surface to be treated, whereupon the pH of the admixture is maintained at a level sufficient for such cleaning efficacy and stability. One liquid includes an oxidizing agent and the other liquid includes a builder or chelating agent. As the two liquids are initially separated, the oxidizing agent can be maintained in an environment free of the builder or chelating agent and otherwise conducive to its cleaning activity and stability up to the time of use.

In the present invention, either or both of the liquids includes a pH-adjusting agent. The pH-adjusting agent is present in an amount such that when the liquids form an admixture during delivery to a surface, the admixture is maintained at a pH sufficient for cleaning efficacy and stability of the oxidizing agent. Thus, when the initially separated liquids are allowed to interact, the resulting liquid cleaning composition being delivered to the surface will have the cleaning or bleaching activity and stability appropriate for the cleaning or bleaching of that surface.

The present invention also relates to an apparatus which maintains the two liquids separately until delivery and provides for such delivery, during which the pH-maintained admixture is formed and delivered to a surface to be treated. The apparatus includes one compartment for the liquid which includes the oxidizing agent and another compartment for the liquid which includes the builder or chelating agent. Either or both of these two compartments may contain the pH-adjusting agent which, collectively, is present in an amount sufficient for cleaning efficacy and stability of the admixture of the two liquids, as described above. According to one aspect of the invention, the apparatus may have separate delivery channels for the two liquid components for delivering the two liquids, whereupon the admixture is formed. These delivery channels may be constructed to provide for the contemporaneous delivery of the two liquids to the exterior of the apparatus, whereupon the two liquids meet to form the admixture. Alternately, the separate delivery channels may communicate with an admixing space in which the two liquids form the admixture and from which the admixture is delivered to the exterior of the apparatus.

In the present invention, a variety of oxidizing agents may be used. For example, the oxidizing agent may be a hypohalite or hypohalite generator, such as a hypochlorite. Further, as disclosed in application Ser. No. 08/605,822 to Choy et al., filed concurrently herewith, the oxidizing agent may be a peroxide or peroxide-generator, such as hydrogen peroxide, or a peracid or persalt, including both organic and inorganic peracids and persalts, such as peracetic acid and monoperoxysulfate, respectively. Accordingly, application Ser. No. 08/605,822 to Choy et al. is incorporated herein in its entirety by this reference.

Additionally, a variety of builders or chelating agents, pH-adjusting agents, and other additives may be used in the present invention. These components may be maintained initially with either or both of the separated liquid components, as convenient, desired, or necessary for compatibility or other purposes.

The oxidizing agent, builder or chelating agent, and the pH-adjusting agent are preferably chosen to provide a composition which is useful for removing mildew or soap scum from a surface, such as wall or floor tile. Additionally, the apparatus for delivering the composition preferably facilitates spray delivery of the composition to the surface.

Additional objects, advantages and features of the various aspects of the present invention will become apparent from the following description of its preferred embodiments, which description should be taken in conjunction with the accompanying drawings.

BRIEF DESCRIPTION OF THE DRAWINGS

FIG. 3 shows plots of hypochlorite concentration versus time for compositions A, B and C of varied caustic (NaOH) concentration;

FIGS. 4, 5 and 6, show plots of pH versus time for mixtures D, E and F, respectively, of varied caustic (NaOH) concentration;

FIG. 7 shows a plot of the hypochlorite (NaOCl) decomposition rate as a function of varied NaOCl concentration;

FIG. 8 shows a plot of the hypochlorite (NaOCl) decomposition rate as a function of varied builder (EDTA) concentration; and FIG. 9 shows a plot of the time required for hypochlorite (NaOCl) decomposition as a function of builder (EDTA) concentration.

DESCRIPTION OF PREFERRED EMBODIMENTS

In the present invention, it has been discovered that a liquid cleaning or bleaching composition which includes an oxidizing agent, a builder or chelating agent, and a pH-adjusting agent, can be formulated and delivered in such a way as to improve the cleaning or bleaching efficacy and stability of the oxidizing agent component. The formulated liquid composition is thus particularly effective in the cleaning or bleaching of a surface. Further, as demonstrated in the examples herein, the formulated liquid composition is especially effective in the cleaning or bleaching of a surface having mildew or soap-scum deposits thereon, such as kitchen or bathroom tile.

While the term "cleaning" typically refers to the removal of soils without use of an oxidizing agent and the term "bleaching" typically refers to the removal of stains using an oxidizing agent, these terms are used to be generally interchangeable for convenience, unless implicitly, obviously, or specifically rendered otherwise.

According to the present invention, individual components of the composition which may be subject to deactivation or destabilization prior to or during formulation of the composition, are protected from deactivation and destabilization. More particularly, prior to such formulation, these components are maintained separately from deactivating and destabilizing environments. Additionally, these components are protected from deactivation and destabilization during the formulation of the composition.

Figure 1:
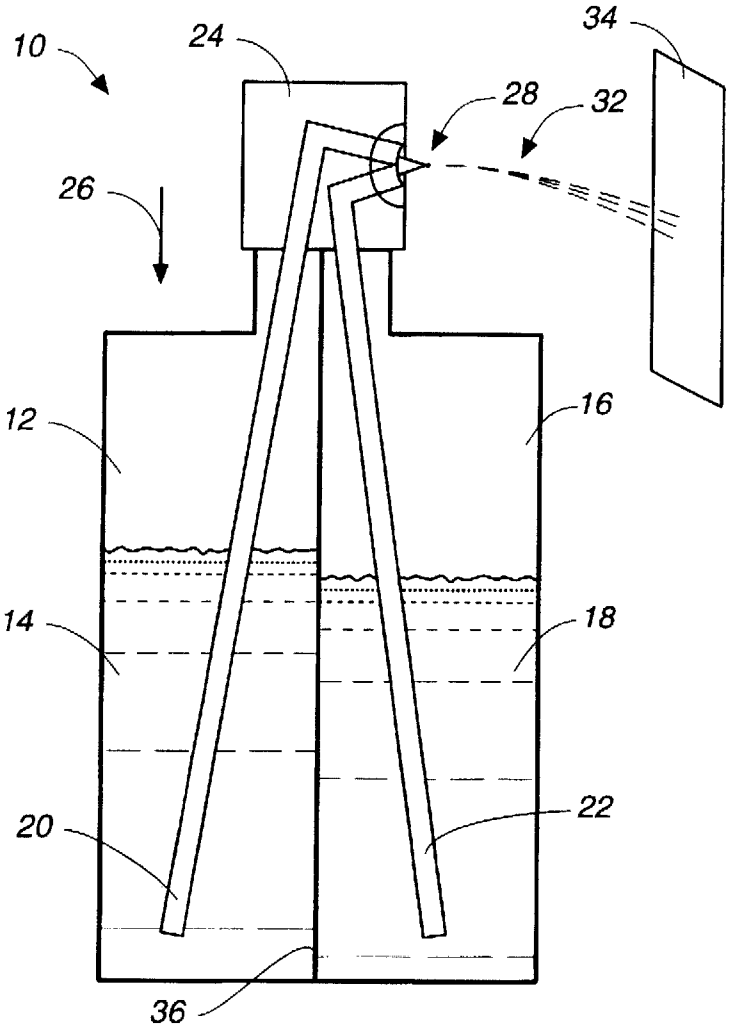
FIG. 1 is a cross-sectional illustration of the apparatus according to an embodiment of the present invention.

FIG. 1 is an illustration of the apparatus 10 of the present invention which maintains two liquids 14 and 18 separately and facilitates formulation and delivery of an admixture 32 thereof for application to a surface 34 to be treated. The apparatus 10 may be divided by a divider 36, such as a wall, into a compartment 12 which contains liquid 14 and another compartment 16 which contains liquid 18. Either or both of liquids 14 and 18 may include one or more components of the composition which might otherwise be subject to a deactivating or destabilizing influence or environment. Each liquid is maintained in its compartment in an environment conducive to a desired level of activity or stability for such components. By way of example, the environment may be one consistent with a pH level or range conducive to the cleaning or bleaching activity or stability of an oxidizing agent component.

While the present invention is described in terms of two compartments which separate two liquid components, it will be understood that additional compartments may be used when it is desirable to maintain additional components separately for compatibility or other purposes. It will also be understood that the apparatus 10 may comprise stand-alone compartments that may be joined together to facilitate the formulation of an admixture of the various components and delivery of the admixture to a surface to be treated.

According to the present invention, one of the liquids, arbitrarily "first" liquid 14, includes an oxidizing agent. The other of the liquids, arbitrarily "second" liquid 18, includes a builder or a chelating agent. (As used herein, the terms builder or chelating agent are interchangeable, unless implicitly, obviously, or specifically rendered otherwise.)

A variety of oxidizing agents, such as the hypochlorites or hypochlorite generators discussed herein, are known to be sensitive to combination with other cleaning additives, such as builders or chelating agents, surfactants, fragrances and solvents. Often a reaction between the oxidizing agent and a builder will result in a rapid, autocatalytic destruction of the oxidizing agent and a rapid reduction in the pH, either or both of which is not conducive to a desired level of cleaning activity or stability for the oxidizing agent. In the present invention, the first liquid 14 which includes such an oxidizing agent, may be maintained in an environment, such as at a preselected pH, that is conducive to a desired level of cleaning activity and stability for that oxidizing agent. Additionally, the first liquid 14 is initially maintained separately from the second liquid 18, which includes a builder, to protect the oxidizing agent from undesirable deactivation or destabilization, such as by autocatalytic destruction.

According to the present invention, either one or both of the first and second liquids 14 and 18 includes a pH-adjusting agent. Preferably, the first liquid 14 which includes the oxidizing agent also includes the pH-adjusting agent. The pH-adjusting agent is present in an amount sufficient to maintain an admixture of the oxidizing agent and the builder at a pH sufficient for cleaning efficacy and stability of the oxidizing agent. Thus, in cases in which the admixing of the oxidizing agent and the builder components would result in a pH which is not conducive to the cleaning efficacy or stability of the oxidizing agent, the pH-adjusting agent protects against such an undesirable condition.

The apparatus 10 of the present invention is of a construction sufficient to deliver the first liquid 14 and the second liquid 18 from compartment 12 and compartment 16, respectively, to form an admixture 32 of the first and second liquids. Thus, the liquids are maintained separately until delivery is desired.

By way of example, the apparatus 10 may include a first delivery channel 20 and a second delivery channel 22 leading from compartment 12 and compartment 16, respectively, to a delivery activator 24. Preferably, the first and second channels 20 and 22 are completely separate to prevent contamination of the first and second compartments subsequent to use. In this manner, after use, any of the first liquid 14 remaining in the first channel flows back into the first compartment 12, while any of the second liquid 18 remaining in the second channel flows back into the second compartment 16.

Figure 2:
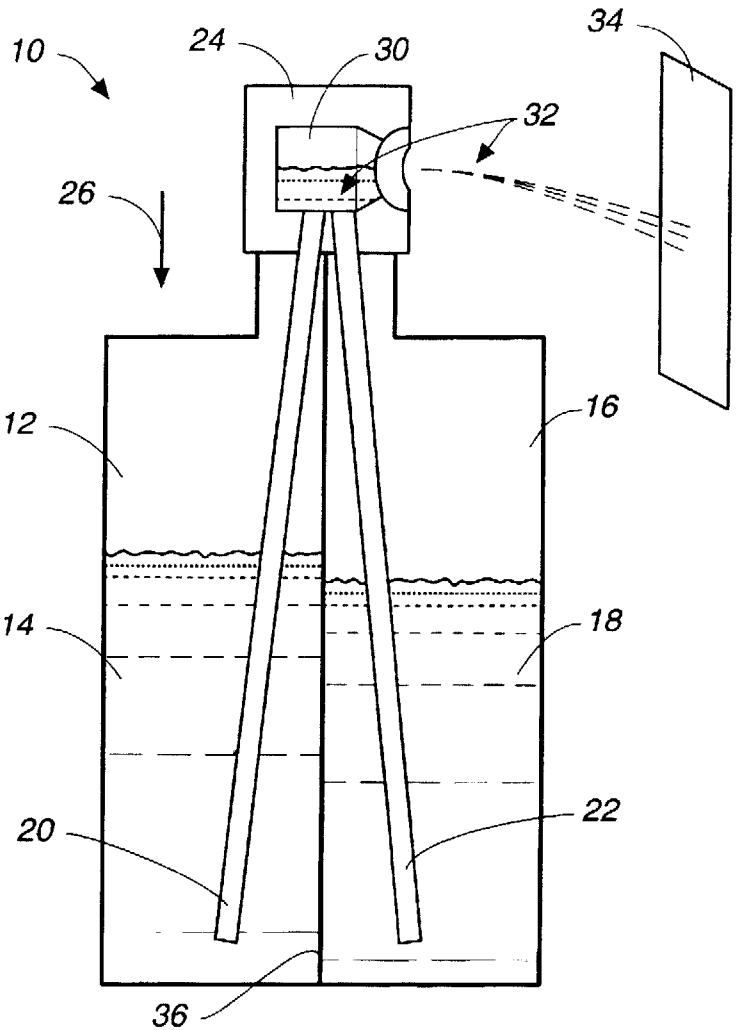
FIG. 2 is a cross-sectional illustration of the apparatus according to another embodiment of the present invention.

The delivery activator 24 may be a pump dispenser (as shown), a trigger sprayer, or the like, which is appropriate for delivery of the two liquids to a location at which the two liquids meet to form an admixture 32. Such a location may be a point 28, external to the apparatus, at which two streams, one for each liquid, intersect to form the admixture 32 during their contemporaneous delivery from the apparatus. Alternately, as shown in FIG. 2, the location may be an admixing space 30, such as a chamber, to which the two liquids are delivered and in which the admixture 32 is allowed to form before its delivery to an exterior of the apparatus. In the latter embodiment, the admixing space may have a preselected volumetric capacity so that only a small volume of admixture may reside therein subsequent to use. For example, the admixing space may have a capacity for about 1.0 milliliter or less of the admixture.

Preferably, the delivery activator 24 is a pump dispenser or a trigger sprayer sufficient for spraying of the two liquids to the intersection point 28 and of the resulting admixture 32 to the surface 34 to be treated (FIG. 1), or of the admixture 32 from admixing space 30 to the surface 34 (FIG. 2). When the delivery activator 24 is a pump dispenser, delivery may be accomplished by depressing the activator in a downward direction which is represented by arrow 26. Preferably, the apparatus can be single-handedly manipulated, such as by holding the apparatus in one hand while depressing the delivery activator with one or more fingers or a thumb of the same hand. When the delivery activator is a trigger sprayer (not shown), delivery may be accomplished by holding a neck of the dispenser apparatus in the cup of one hand while pulling the trigger activator inwardly with respect to the neck with one or more fingers of the same hand, as is well known.

Preferably, the delivery activator includes a closing mechanism (not shown) to prevent undesired, post-use delivery, such as during a child's meddling with the apparatus, or undesirable dripping or shooting of liquid from the apparatus. Regarding the first two of these potential undesirable events, a child-proof and/or a conventional, drip-preventing closing mechanism may be employed. Many such mechanisms are known and employed commercially.

Regarding the undesirable shooting of liquid from many conventional dispensing systems, it appears that this shooting occurs when gas is produced by the contents of the dispenser and allowed to accumulate in the closed dispenser. When the closing mechanism is moved from a closed to an open position, accumulated gas pressure can cause the shooting of liquid from the dispenser.

This occurrence is reduced or avoided in the present invention, as the two liquids which might otherwise produce gas, are separated prior to delivery. Additionally, in the embodiment of FIG. 1, these two liquids interact only upon delivery to an exterior to the apparatus, so that any gas that might be produced by the admixture of these two liquids is not produced in the apparatus interior. Further, in the embodiment of FIG. 2, the admixing space 30 is preferably limited in volumetric capacity so that only a small amount of the admixture may be formed upon delivery of the two liquids thereto and thus, possibly remains therein after use. This volumetric capacity may be selected such that only a small or insignificant amount (in terms of possible gas production) of the admixture may remain in the admixing space after use, such that little, if any, gas is produced or accumulated. Thus, according to the embodiment of FIG. 2, shooting of liquid may be eliminated or reduced in occurrence or effect (i.e., the shooting force and the distance of travel and amount of the shooting liquid). According to either of these embodiments, after delivery, liquid in either of the separate delivery channels returns to its original compartment where it does not interact with the other separately compartmentalized liquid. This further eliminates or reduces the potential for gas production from the admixing of the two liquids.

Other delivery activators may be chosen to accommodate various delivery arrangements or applications, such as delivery to hard-to-reach surfaces. Further, while the surface 34 is shown as a vertical surface, such as a wall, it will be understood that the surface may be oriented otherwise, such as at an angle or horizontally, or may be the surface of a mop, sponge, cloth, or the like, which will be used in a cleaning application.

The apparatus 10 will be understood further in terms of the following description of a composition which is produced by a process, according to the present invention. The composition 32, which is useful for bleaching or cleaning a surface 34, is produced by a process of maintaining a first liquid 14 and a second liquid 18 separately and forming an admixture 32 thereof during delivery to a surface 34. As described above, the first liquid 14 includes an oxidizing agent, the second liquid 18 includes a builder or a chelating agent, and at least one of the first and second liquids includes a pH-adjusting agent. The pH-adjusting agent is present in an amount such that the admixture 32 is maintained at a pH sufficient for cleaning efficacy and stability of the oxidizing agent.

Oxidizing Agents

The oxidizing agent which is included in the first liquid 14 is now described. In the present invention, the oxidizing agent is present in an amount ranging from about 0.1 to about 50 weight percent of the first liquid. Generally, the amount of oxidizing agent is preferably from about 1 to about 20 weight percent of the first liquid and more preferably from about 5 to about 10 weight percent of the first liquid, although when the oxidizing agent is a hypohalite or hypohalite generator (further described herein), such as sodium hypochlorite, the amount is preferably from about 0.1 to about 15 weight percent of the first liquid.

According to the present invention, the oxidizing agent may be a halogen bleach. Preferably, the oxidizing agent is a halogen bleach source which may be selected from various hypohalite-producing species, for example, bleaches selected from the group consisting of the alkali metal and alkaline earth salts of hypohalite, haloamines, haloimines, haloimides and haloamides. All of these are believed to produce hypohalous bleaching species in situ.

Preferably, the oxidizing agent is a hypohalite or a hypohalite generator capable of generating hypohalous bleaching species. Hereafter, the term "hypohalite" is used to describe both a hypohalite or a hypohalite generator, unless otherwise indicated. Preferably, the hypohalite oxidizing agent is a hypochlorite or a generator of hypochlorite in aqueous solution, although hypobromite or a hypobromite generator is also suitable. Representative hypochlorite generators include sodium, potassium, lithium, magnesium and calcium hypochlorite, chlorinated trisodium phosphate dodecahydrate, potassium and sodium dichloroisocyanurate and trichlorocyanuric acid. Organic bleach sources suitable for use include heterocyclic N-bromo and N-chloro imides such as trichlorocyanuric and tribromocyanuric acid, dibromocyanuric acid and dichlorocyanuric acid, and potassium and sodium salts thereof, N-brominated and N-chlorinated succinimide, malonimide, phthalimide and naphthalimide. Also suitable are hydantoins, such as dibromodimethylhydantoin and dichlorodimethyl-hydantoin, chlorodimethylhydantoin, N-chlorosulfamide (haloamide) and chloramine (haloamine).

More preferably, the hypohalite oxidizing agent is an alkali metal hypochlorite, an alkaline earth salt of hypochlorite, or a mixture thereof. A particularly preferred oxidizing agent in this embodiment is sodium hypochlorite, having the chemical formula NaOCl.

Builder or Chelating Agents

The builder or chelating agent which is included in the second liquid 18 is now described. In the present invention, the builder is present in an amount ranging from about 0.1 to about 30 weight percent of the second liquid. The amount of builder is preferably from about 1 to about 20 weight percent of the second liquid and more preferably from about 5 to about 15 weight percent of the second liquid.

According to the present invention, suitable builders may be selected from the group consisting of a carbonate, a phosphate, a pyrophosphate, an amino carboxylate, a polycarboxylate, a polyacrylate, a phosphonate, an amino phosphonate, a polyphosphonate, a salt thereof, and a mixture thereof. Suitable builders include ethylenediaminetetraacetic acid ("EDTA"), tartaric acid, citric acid, nitrilotriacetic acid ("NTA"), sodium carboxymethylsuccinic acid, sodium N-(2-hydroxypropyl)-iminodiacetic acid, (N-hydroxyethyl)ethylenediaminetriacetic acid ("HEDTA"), N-diethyleneglycol-N,N-diacetic acid ("DIDA"), diethylenetriaminepentaacetic acid ("DTPA"), a salt thereof, and a mixture thereof. Suitable polyacrylate builders are commercially available, for example, from Rohm & Haas of Philadelphia, Pa. under the name ACUSOL and from BASF of Parsippany, N.J. under the name SOKALAN. Further, suitable chelating agents may be selected from the group consisting of a gluconic acid, a salt thereof, and a mixture thereof. Such chelating agents are commercially available, for example, as PMP Sodium Gluconate from PMP Fermentation Products of Rosemont, Ill. The salts are preferably compatible and include ammonium, sodium, potassium, and alkanol-ammonium salts.

A preferred builder is NTA, such as sodium salt of NTA. A more preferred builder is citrate, such as sodium or monoethanolamine salt of citrate. An even more preferred builder is tartaric acid. Most preferably, the builder is EDTA, such as sodium salt of EDTA.

pH-Adjusting Agents

The pH-adjusting agent which is present in either one or both of the two liquids 14 and 18 is now described. According to the present invention, the pH-adjusting agent maintains the pH of the admixture of the two liquids such that the oxidizing agent is sufficiently stable and efficacious as a cleaning active. As used herein, the term "pH-adjusting agent" includes an agent which may act to adjust the pH of the admixture as well as a buffer which may act to maintain the pH of the admixture.

Preferably, the pH-adjusting agent is selected from the group consisting of a hydroxide, a hydroxide generator, a buffer, and a mixture of same. Appropriate pH-adjusting agents include alkali metal salts of various inorganic acids, such as alkali metal phosphates, polyphosphates, pyrophosphates, triphosphates, tetraphosphates, silicates, metasilicates, polysilicates, borates, carbonates, bicarbonates, hydroxides, and mixtures of same. A preferred pH-adjusting agent is an alkali metal hydroxide, especially sodium hydroxide.

Also suitable as pH-adjusting agents are monoethanolamine compounds, such as diethanolamine and triethanolamine, and beta-aminoalkanol compounds, particularly beta-aminoalkanols having a primary hydroxyl group, and a mixture thereof. Suitable amine compounds should exhibit reasonable solubility relative to the admixture.

In the present invention, the admixture is maintained at a pH which is appropriate for cleaning activity and stability of the oxidizing agent. When the oxidizing agent is a hypohalite, the admixture pH is alkaline.

For example, when a hypohalite oxidizing agent is used, the pH of the admixture is preferably maintained at above about 11, such as from above about 11 to 11.5, and more preferably at about 12 or above. An admixture pH of above about 11 is believed to be sufficient for both the cleaning efficacy and the stability of hypohalite. More particularly, this admixture pH is believed to be sufficient to protect against the rapid, autocatalytic destruction of the hypohalite (via reaction with the builder) that might otherwise occur when the admixture is formed.

According to the present invention, the amount of pH-adjusting agent is present in one or both of the first and second liquids in an aggregate amount sufficient to adjust the pH of the admixture to the desired level, as described above. By way of example, the pH-adjusting agent may be present in an amount between about 0.1 and about 30 weight percent of one of the liquids or in an amount between about 0.05 and about 15 weight percent of the admixture. Preferably, the pH-adjusting agent is present in an amount between about 0.1 and about 20 weight percent of one of the liquids or in an amount between about 0.05 and about 10 weight percent of the admixture.

Additives

The composition of the present invention can be formulated to include additives, such as fragrances, coloring agents, whiteners, thickening agents, chelating agents and builders, solvents, surfactants, and disinfectants, and the like, which enhance performance, stability or aesthetic appeal of the compositions. Such components can be included in either one or both of the two liquids 14 and 18, according to compatibility, desirability, convenience, or other factors. Generally, all of these additives are also selected with the characteristic of being resistant to the oxidizing agent employed.

Fragrances, such as those commercially available from International Flavors and Fragrance, Inc., may be included in any of the compositions produced according to the embodiments described herein. Suitable fragrances may take the form of fragrance oils. A fragrance or mixture of fragrances may be present in an amount of from about 0.01 to about 2.0 weight percent of the composition. Preferably, a fragrance or mixture of fragrances is present in am amount from about 0.1 to about 1 weight percent of the composition.

When the oxidizing agent is a halogen bleach, such as a hypohalite, fragrance additives are preferably included in the second liquid 18 which includes the builder and is preferably maintained at a pH appropriate for fragrance stability. When the fragrance is included in the second liquid 18, it is preferable to include the pH-adjusting agent in the first liquid 14 which includes the oxidizing agent, so as not to interfere with fragrance stability.

Dyes and pigments may be included in small amounts. Ultramarine Blue (UMB) and copper phthalocyanines are examples of widely used pigments which may be incorporated in the compositions produced according to the present invention.

Suitable builders, as also discussed above, may be optionally included in the composition. Such builders include but are not limited to carbonates, phosphates and pyrophosphates, which are known to reduce the concentration of free alkali metal ions in aqueous solution. Certain suitable pH-adjusting agents, such as carbonates, phosphates, phosphonates, polyacrylates and pyrophosphates also function as builders. Typical builders which do not also function as pH-adjusting agents include sodium and potassium tripolyphosphate and sodium or potassium hexametaphosphate. These builders ay also function as electrolytes.

Various solvents, surfactants, and disinfectants may also be included in the composition. For example, suitable solvents include alcohols, glycols and glycoethers. Glycols and glycoether solvents are preferred as generally being less odorous, less volatile and more compatible with other cleaning components than are alcohol solvents. Diethyleneglycol and ethyleneglycol n-butyl ether are preferred, the former being the more preferred.

Further by way of example, suitable solvents for use herein include propylene glycol t-butyl ether and propylene glycol n-butyl ether, which readily improve non-streaking/non-filming performance of the composition. If mixtures of solvents are used, the amounts and ratios of such solvents used are important in determining the optimum cleaning and streak/film performances of the inventive composition. It is preferred to limit the total amount of solvent to no more than 50 weight percent, more preferably no more than 25 weight percent, and most preferably, no more than 15 weight percent, of the composition. A preferred range for the total amount of solvent is about 1–15 weight percent of the composition, although in some of the compositions of this invention, solvent may be omitted. If a mixed solvent system of alkanol/glycol ether is used, the ratio of alkanol to alkylene glycol ether should be about 1:20 to 20:1, more preferably about 1:10 to 1:10, and most preferably about 1:5 to 5:1.

Other, less water soluble or dispersible organic solvents may also be used herein, although in a high water formulation, there may be a need for a further dispersant (e.g., hydrotrope or other emulsifier). These less water soluble or dispersible organic solvents include those commonly used as constituents for proprietary fragrance blends, such as terpene derivatives. The terpene derivatives herein include terpene hydrocarbons with a functional group. Effective terpenes with a functional group include, but are not limited to, alcohols, ethers, esters, aldehydes and ketones.

Representative examples for each of the above classes of terpenes with functional groups include but are not limited to the following: (1) terpene alcohols, including, for example, verbenol, transpinocarveol, cis-2-pinanol, nopol, iso-borneol, carbeol, piperitol, thymol, -terpineol, terpinen-4-ol, menthol, 1,8-terpin, dihydro-terpineol, nerol, geraniol, linalool, citronellol, hydroxycitronellol, 3,7-dimethyl octanol, dihydro-myrcenol, -terpineol, tetrahydro-alloocimenol and perillalcohol; (2) terpene ethers and esters, including, for example, 1,8-cineole, 1,4-cineole, isobornyl methylether, rose pyran, -terpinyl methyl ether, menthofuran, trans-anethole, methyl chavicol, allocimene diepoxide, limonene mono-epoxide, iso-bornyl acetate, nopyl acetate, -terpinyl acetate, linalyl acetate, geranyl acetate, citronellyl acetate, dihydro-terpinyl acetate and neryl acetate; and (3) terpene aldehydes and ketones, including, for example, myrtenal, campholenic aldehyde, perillaldehyde, citronellal, citral, hydroxy citronellal, camphor, verbenone, carvenone, dihyrocarvone, carvone, piperitone, menthone, geranyl acetone, pseudo-ionone, -ionone, -ionone, iso-pseudo-methyl ionone, normal-pseudo-methyl ionone, iso-methyl ionone and normal-methyl ionone. Terpene hydrocarbons with functional groups which appear suitable for use in the present invention are discussed in substantially greater detail by Simonsen and Ross, The Terpenes, Volumes I–V, Cambridge University Press, 2nd Ed., 1947 (incorporated herein by reference thereto). See also, the commonly assigned U.S. Pat. No. 5,279,758, of Choy, incorporated herein in its entirety by this reference.

Further by way of example, suitable surfactants include cosurfactants which are added to the composition for various purposes (such as cleaning, stability, thickening, etc.) which may be selected initially on the basis of cleaning ability. The surfactants may be also selected on the basis of moderate to high stability in the presence of bleach, although such stability is not necessary given that the surfactants may be compartmentalized separately from bleaching agents in the present invention.

Generally, a wide variety of surfactants may be stable in the presence of bleaches such as hypochlorite in an aqueous solution, including but not limited to amine oxides, betaines, sarcosinates, taurates, alkyl sulfates, alkyl sulfonates, alkyl aryl sulfonates, alkyl phenol ether sulfates, alkyl diphenyl oxide sulfonates, alkyl phosphate esters, etc. Generally, such cosurfactants may be any of a variety of different types including anionics, non-ionics, amphoterics, etc.

For example, lauroyl sarcosinates are suitable cosurfactants since they are particularly resistant to oxidation by bleach materials such as hypochlorite. Accordingly, these materials are bleach-resistant, even at elevated temperatures. Hydrotropes such as $C_{6-12}$ alkyl sulfonate, toluene sulfonate, xylene sulfonate, cumene sulfonate and alkyl naphthalene sulfonate salts of alkali metals are also useful. Preferred cosurfactants are $C_{6-12}$ alkyl sulfonate and sodium salt of a $C_{6-12}$ sulfonic acid.

In any event, the specific identity of the cosurfactant is not critical to the present invention as long as the cosurfactant is relatively bleach stable and compatible with the other components of the composition to perform either bleaching or stabilizing functions.

Suitable disinfectants, which may augment the disinfecting action of the oxidizing agent, include the following: (1) mercury compounds, such as mercuric chloride, phenylmercuric borate; (2) halogens and halogen compounds, such as chlorine, iodine, fluorine, bromine, calcium and sodium hypochlorite; (3) phenols, such as creosol from coal tar and ortho-phenylphenol; (4) synthetic detergents, for example, anionic detergents such as sodium alkyl benzene sulfonates, and cationic detergents such as quaternary ammonium compounds; (5) alcohols, such as alcohols of low molecular weight (excepting methanol); (6) natural products, such as pine oil; and (7) gases, such as sulfur dioxide, formaldehyde, and ethylene oxide.

EXAMPLES

An exemplary embodiment of the inventive composition produced by the process described herein comprises the components which are listed below for Example 1. These components are grouped according to their preferred presence in either liquid 14 ("Liquid 1") or liquid 18 ("Liquid 2"). Further, the preferred amount of each component is provided in terms of a range of the weight percent of that component relative to Liquid 1 or Liquid 2 which includes that component.

Example 1

| Component | Weight Percent (%) |
|---|---|
| Liquid 1: | |
| Sodium Hypochlorite | 0.1–15 |
| Sodium Hydroxide | 0.1–3 |
| Sodium Carbonate | 0–8 |

-continued

| Component | Weight Percent (%) |
|---|---|
| Sodium Silicate | 0–8 |
| Water | Remainder |
| Liquid 2: | |
| Ethylenediaminetetraacetic acid (EDTA) | 1–15 |
| Diethyleneglycol or Ethylene glycol n-butyl ether | 0–15 |
| $C_{6-12}$ Alkyl Sulfonate | 1–8 |
| $C_{10-12}$ Alcohol Ethoxylate (6 moles ethoxylate) | 0–5 |

In this example, diethyleneglycol n-butyl ether may be in the form commercially available from Dow Chemical Co. under the name DOWANOL DB. Additionally, the $C_{10-14}$ alcohol ethoxylate may be an ethoxylated linear primary alcohol or an ethoxylated octyl-phenol alcohol which is a surfactant commercially available from Union Carbide of Danbury, Conn. under the name TRITON X-100. The $C_{6-12}$ alkyl sulfonate may be a sodium salt of a $C_{6-12}$ sulfonic acid.

Hypochlorite Compositions

In an embodiment comprising a hypochlorite oxidizing agent, the inventive composition is produced by admixing Liquids 1 and 2 of Example 1, as described herein, wherein the components listed in Table 1, below, are present in the amounts shown therein (in weight percent relative to Liquid 1 or Liquid 2 which includes that component).

TABLE 1

| Component | Weight Percent (%) of Liquid 1 or 2 |
|---|---|
| Sodium Hypochlorite | 5.5 |
| Sodium Hydroxide | 0.5 |
| EDTA | 10.8 |
| Diethyleneglycol n-butyl ether | 9.0 |
| Ethoxylated octylphenol | 6.0 |
| Fragrance Oil | 0.3 |

In a preferred embodiment comprising a hypochlorite oxidizing agent, the inventive composition is produced by admixing Liquids 1 and 2 of Example 1, as described herein, wherein the components listed in Table 2, below, are present in the amounts shown therein (in weight percent relative to Liquid 1 or Liquid 2 which includes that component).

TABLE 2

| Component | Weight Percent (%) of Liquid 1 or 2 |
|---|---|
| Sodium Hypochlorite | 5.5 |
| Sodium Hydroxide | 0.75 |
| EDTA | 10.8 |
| Ethyleneglycol n-butyl ether | 9.0 |
| Sodium salt of a $C_{6-12}$ sulfonic acid | 3.75 |
| Ethoxylated $C_{10-14}$ alcohol | 2.0 |
| Fragrance Oil | 0.65 |

Performance Tests

In experiments conducted to test the performance of the inventive composition, various admixtures 32 were formulated by admixing a first liquid 14 and a second liquid 18, as described herein. These admixtures were then tested to determine their performance in the removal of mildew and soap scum from a soiled tile having an area of three inches squared.

For the mildew performance tests, soiled tiles were prepared by painting them with killed A. Niger mildew and allowing the mildew to dry. For the soap scum performance tests, soiled tiles were prepared by applying a standard one coat of soap scum to the tiles and allowing the soap scum to dry. Each admixture was sprayed onto the soiled tile, as described herein, and then rated by a panel of ten people in terms of the level of cleaning. The rating scale ranged from one (1) for no cleaning to ten (10) for complete cleaning.

In the performance tests, a concentrated bathroom cleaner (hereinafter, "CBC") was used as the second liquid, which includes a builder. CBC comprises EDTA as the builder, ethyleneglycol n-butyl ether, sodium salt of $C_{6-12}$ sulfonic acid, and ethoxylated $C_{10-14}$ alcohol in the amounts of 10.8, 9.0, 3.75, and 2.0 in weight percent of the second liquid and is present in the composition shown in Table 2. In the performance tests for hypochlorite compositions, in various admixtures (below), water or CBC without the EDTA builder replaced the CBC and was used as a control for the second liquid.

Performance of Hypochlorite Compositions

In the performance tests for the hypochlorite compositions, the five admixtures listed below were tested.

| Admixture | Liquid 1 (weight percent) | Liquid 2 |
|---|---|---|
| 1 | 100% Water | Water |
| 2 | 100% Water | CBC |
| 3 | 5.5% Sodium Hypochlorite<br>0.75% Sodium Hydroxide | Water |
| 4 | 5.5% Sodium Hypochlorite<br>0.75% Sodium Hydroxide | CBC |
| 5 | 5.5% Sodium Hypochlorite<br>0.75% Sodium Hydroxide | CBC without EDTA |

The panel ratings for mildew and soap scum performance are shown below.

| Admixture | Mildew Performance | Soap Scum Performance |
|---|---|---|
| 1 | 2 | * |
| 2 | 1 | 10 |
| 3 | 9 | 1 |
| 4 | 7 | 9 |
| 5 | * | 2 |

*not tested.

The mildew performance ratings indicate that in the inventive composition, sodium hypochlorite, as opposed to water, is necessary for the effective removal of mildew. The results also show that the sodium hypochlorite has sufficient cleaning efficacy and stability in the presence of the EDTA builder, when used according to the present invention.

The soap scum performance ratings indicate that the EDTA builder is necessary for the removal of soap scum. Further, the results show that the EDTA builder, functions in the removal of soap scum in the presence of the sodium hypochlorite oxidizing agent.

Hypochlorite Compositions

Inventive compositions comprising a hypohalite oxidizing agent are now further described in relation to FIGS. 3–9. These inventive compositions comprise sodium hypochlorite (NaOCl) as the oxidizing agent, ethylenediaminetetraacetic acid (EDTA) as the builder, and sodium hydroxide (NaOH) as the pH-adjusting agent.

In the absence of any other materials, a mixture of a bleach solution of about 1 to 10 weight percent NaOCl and a builder or chelant solution of about 2 to 15 weight percent EDTA has little available hypochlorite remaining after about three minutes. The rapidity of hypochlorite destruction in such a mixture results from the formation of acidic species from the reaction between hypochlorite and EDTA. This acidic species formation accelerates the hypochlorite-EDTA reaction by lowering the pH and making the hypochlorite species more reactive.

For effective bleaching performance, the hypochlorite should be present for at least from about 5 to 10 minutes. According to the present invention, for bleach (hypochlorite) stability beyond about five minutes, it is necessary to add NaOH (or other pH-adjusting agent) to the above-described hypochlorite-EDTA mixture so that the initial NaOH concentration is at least about 0.2 weight percent of the admixture (or an equivalent amount of a pH-adjusting agent other than NaOH). A greater concentration of NaOH in the hypochlorite-EDTA-NaOH admixture, results in a longer effective bleaching time of the admixture. A limit is reached at about 2 weight percent NaOH relative to the admixture, such that the addition of more caustic will not effect the effective bleaching time. For this limiting case of about 2 weight percent NaOH relative to the admixture, about 5.5 weight percent NaOCl relative to the bleach solution, and about 10 weight percent EDTA relative to the builder solution, the effective bleaching time, or bleach half-life, is about 40 minutes.

Figure 3:
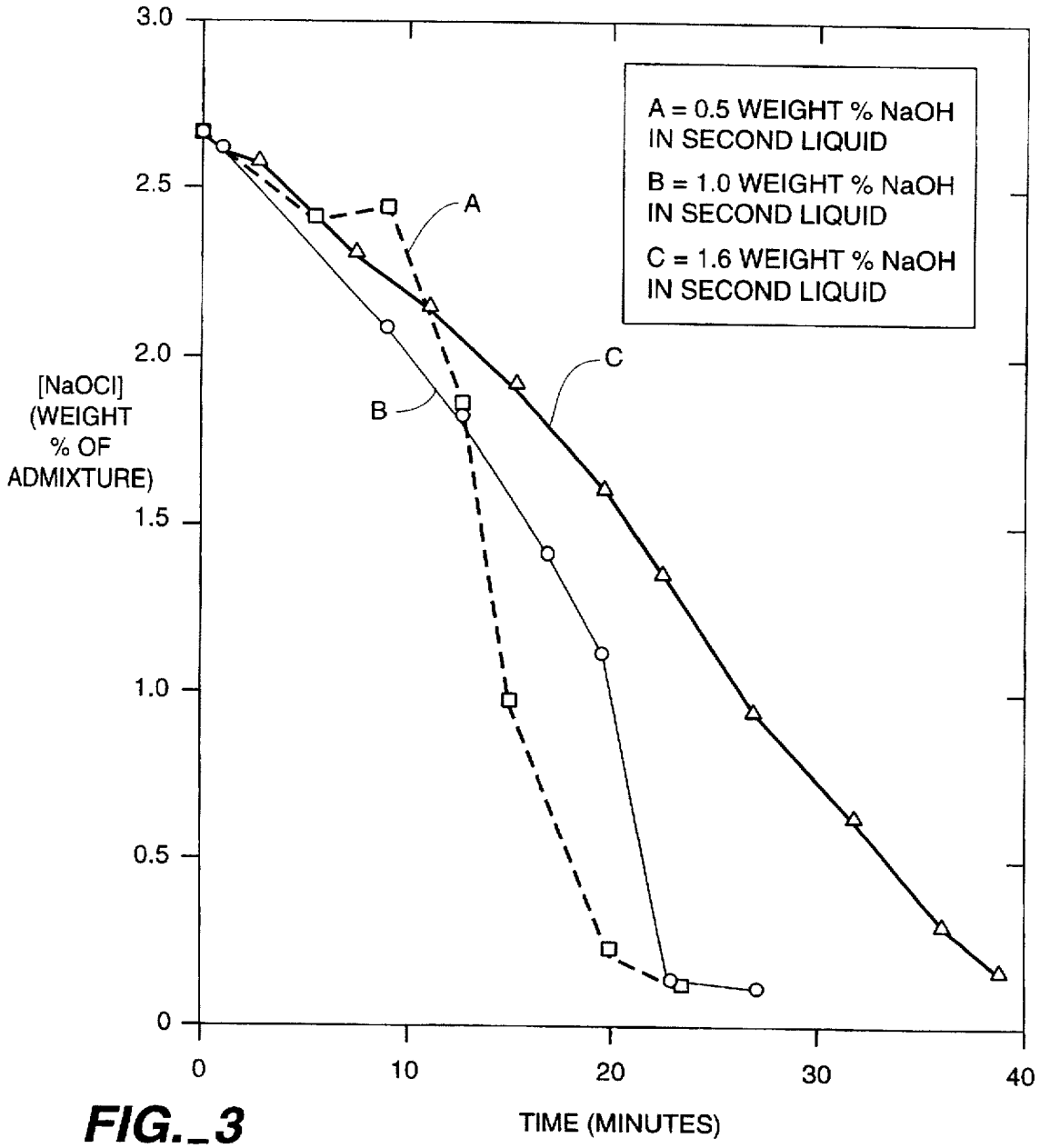
FIGS. 3–9 are graphical representations of data for inventive compositions including a hypochlorite (NaOCl) oxidizing agent, briefly described as follows.

As shown in FIG. 3, the bleach half-life of hypochlorite may be controlled based on the amount of NaOH in the inventive composition. FIG. 3 shows effective bleaching times for three different mixtures A, B and C, for which the NaOH concentration was varied, as described below.

Particularly, the data for FIG. 3 were obtained from mixtures of a first liquid, including NaOCl at 5.5 weight percent of the first liquid, and a second liquid, including an EDTA-containing cleaning formulation of EDTA, diethylene glycol n-butyl ether, and a surfactant, ethoxylated octylphenol alcohol (as TRITON X-100), in the amounts of 10.8, 9.0, and 6.0 weight percent of the second liquid, respectively. For the three different mixtures A, B, and C, the second liquid also included NaOH in the amounts of 0.5, 1.0 and 1.6 weight percent of the second liquid, respectively. Upon mixing the first and second liquids, the amount of NaOCl remaining over time (beginning at approximately 2.75 weight percent of the admixture when sprayed) was determined and plotted, as shown, for each of the mixtures A, B, and C.

FIG. 3 shows that the inventive composition provides effective bleaching times of from about 5 to about 10 minutes, which is considered sufficient for effective performance, and preferably of from about 20 to about 40 minutes, which is considered sufficient for more optimal performance. The data show that for the three mixtures A, B and C, a greater NaOH concentration (0.5, 1.0 and 1.6 weight percent of the second liquid, respectively) results in a longer effective bleaching time (about 23, 27 and 40 minutes, respectively).

Figure 4:
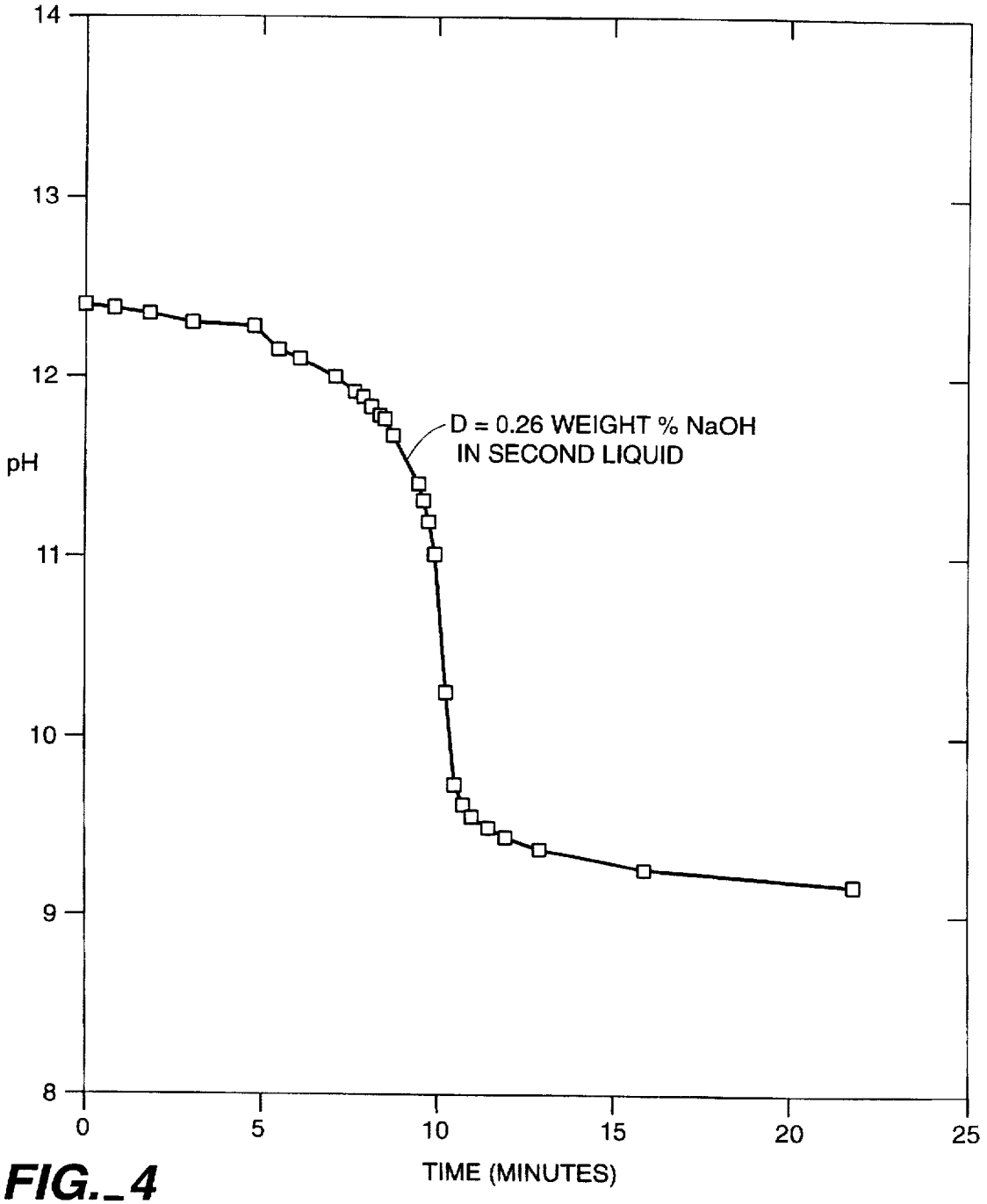
Figure 5:
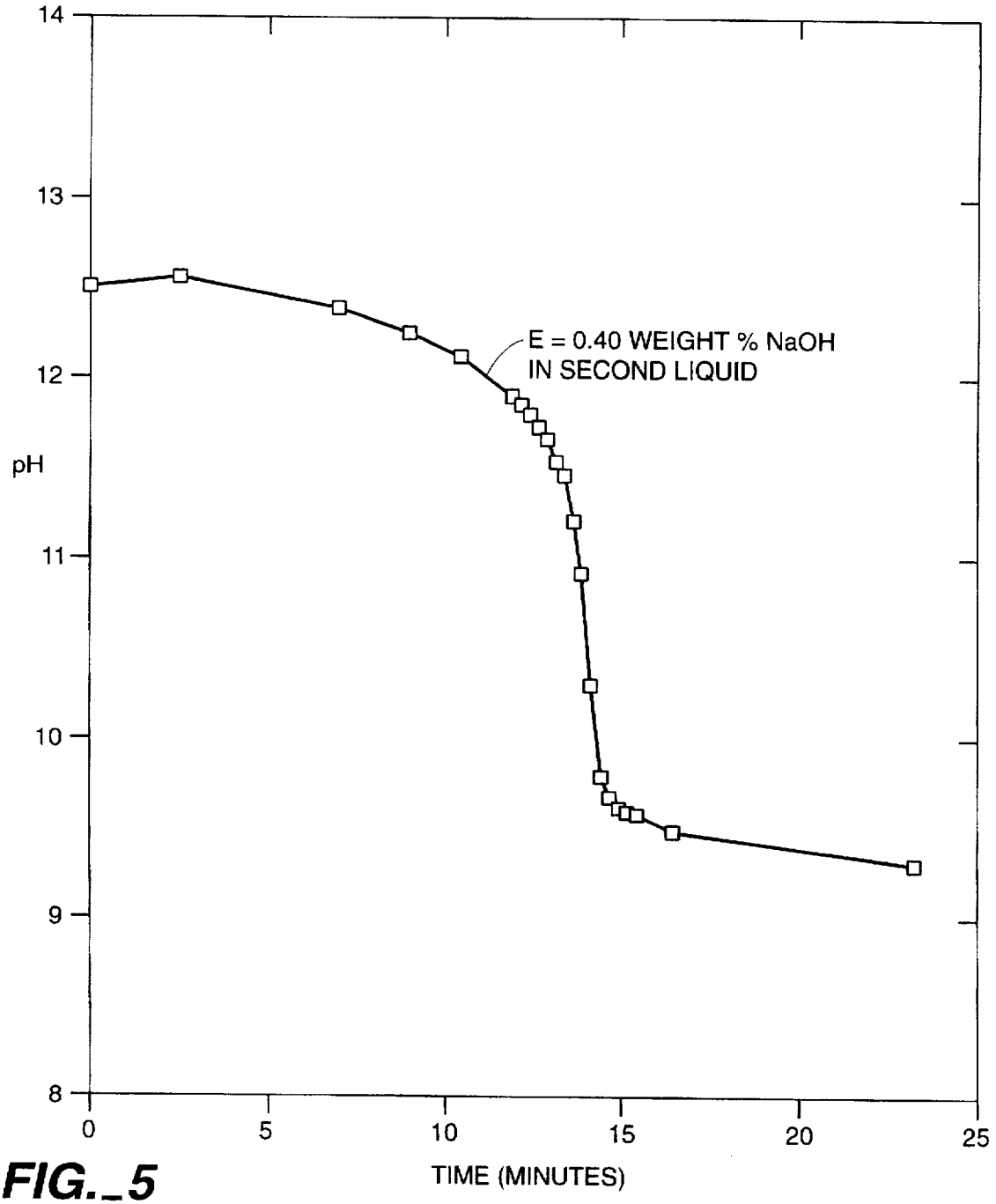
Figure 6:
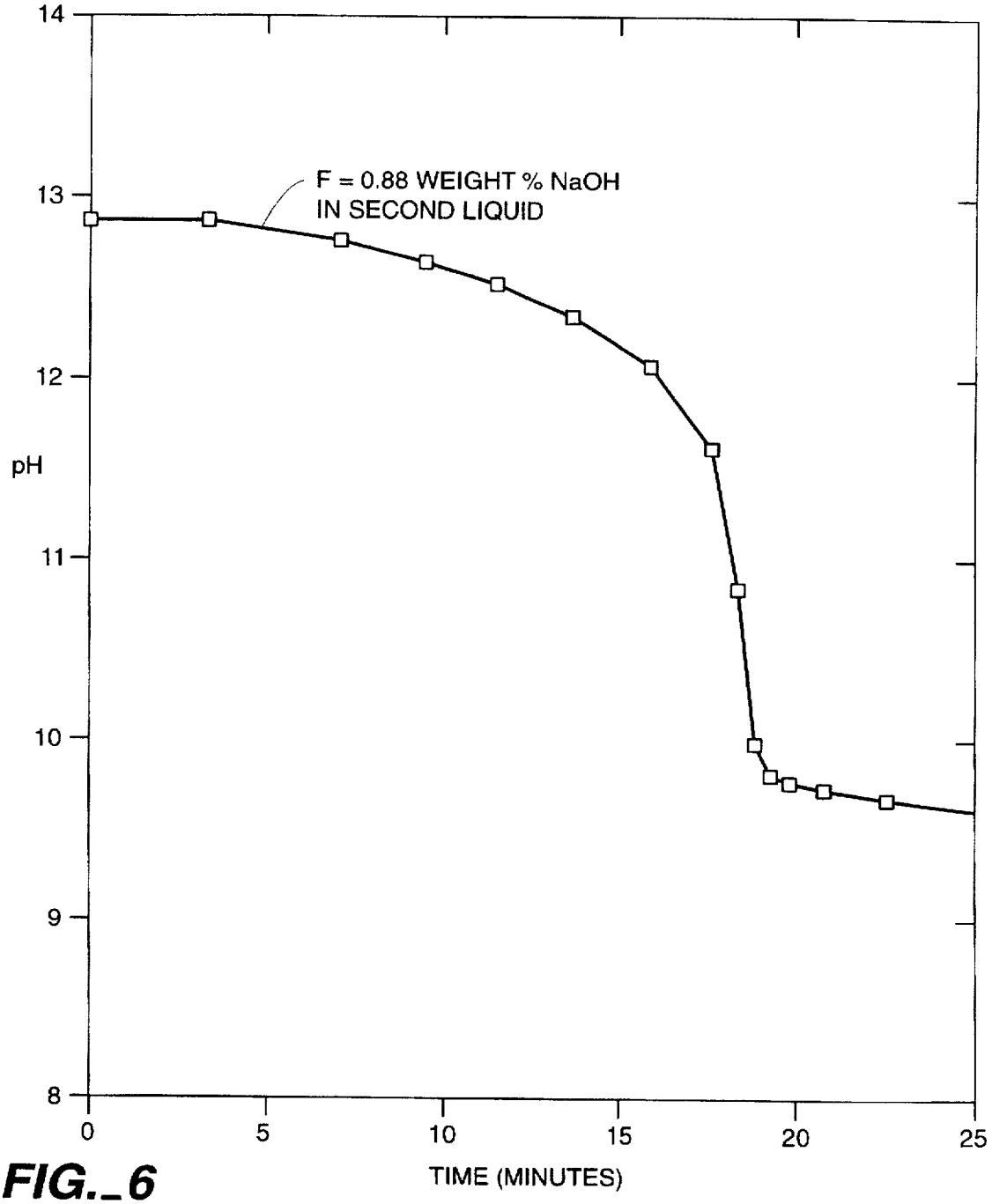

As shown in FIGS. 4–6, the bleach half-life of hypochlorite may be controlled based on the pH of the inventive composition over time. FIGS. 4, 5 and 6, show effective bleaching times for three different mixtures D, E and F, respectively, for which the NaOH concentration was varied, as described below.

Particularly, the data for FIGS. 4–6 were obtained from mixtures of a first liquid, including NaOCl, and a second liquid, including an EDTA-containing cleaning formulation, as described above in relation to FIG. 3. For the three different mixtures D, E and F, the second liquid also included NaOH in the amounts of 0.26, 0.40 and 0.88 weight percent of the second liquid, respectively. Upon mixing the first and second liquids, the pH of the mixture over time was determined and plotted, as shown, for each of the mixtures D, E and F.

FIGS. 4–6 show that the pH of each mixture is initially high, between 12 and 13, and then drops sharply (around a pH of about 11) as the NaOCl is consumed. As shown, the three mixtures provide effective bleaching times of from about 5 to about 10 minutes, which is considered sufficient for effective performance, and preferably from about 10 to about 20 minutes, which is considered sufficient for more optimal performance. The data show that for the three mixtures D, E and F, a greater NaOH concentration (0.26, 0.40 and 0.88 weight percent of the second liquid, respectively) results in a longer effective bleaching time (about 10, 14 and 18 minutes, respectively).

Figure 7:
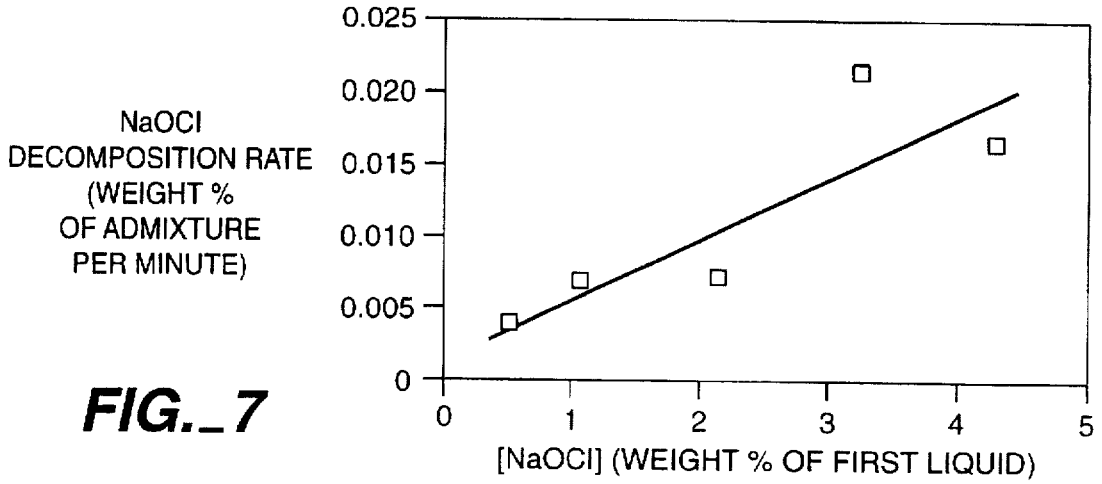
Figure 8:
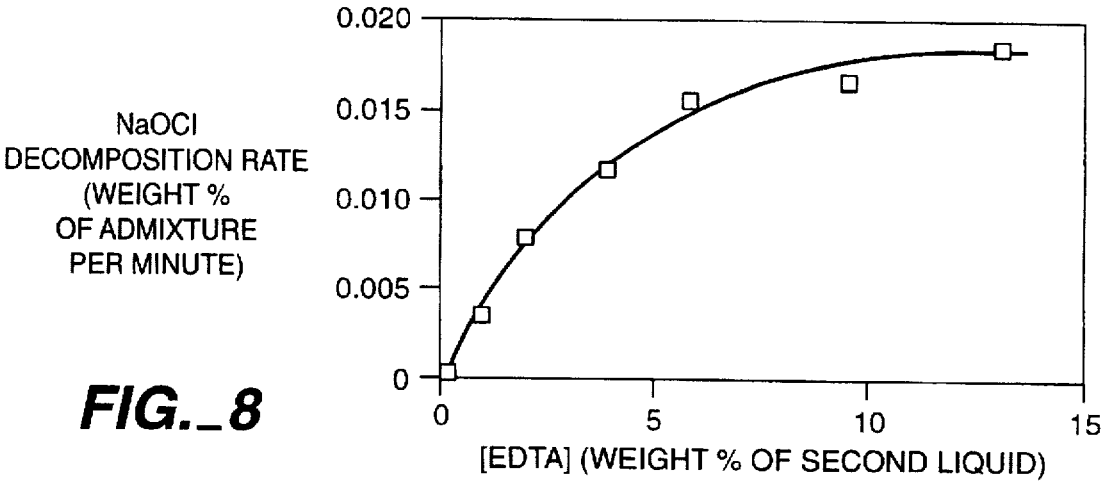
Figure 9:
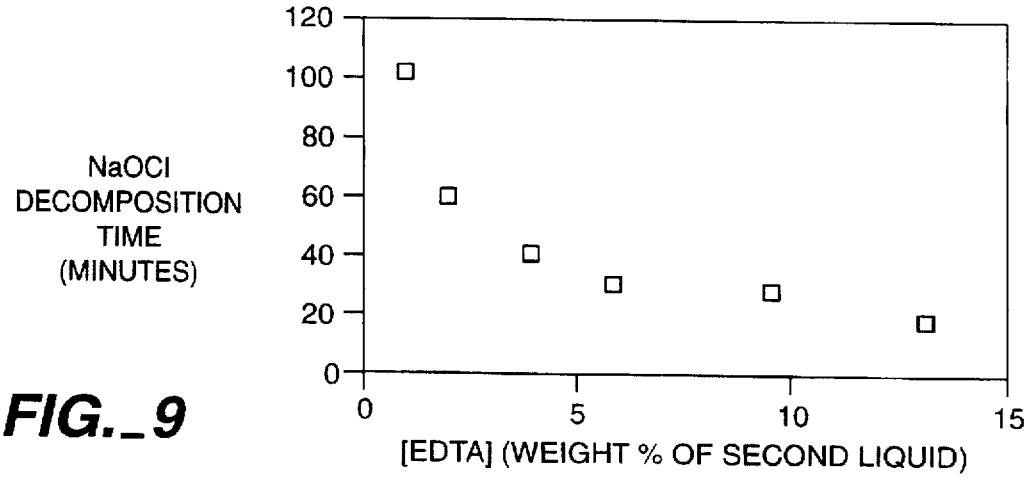

FIGS. 7–9 show the effect of various components of the inventive composition on bleach decomposition. For example, FIG. 7 shows the effect of NaOCl concentration on the NaOCl decomposition rate. The data for FIG. 7 were obtained from mixtures of a first liquid, including varying amounts of NaOCl (in weight percent of the first liquid), and a second liquid, including the EDTA-containing cleaning formulation described above in relation to FIGS. 3–6. The second liquid also included NaOH in the amount of 0.5 weight percent of the second liquid. Upon mixing the first and second liquids, the NaOCl decomposition rate, or reduction of NaOCl concentration (in weight percent of the mixture) over time, for each mixture was determined and plotted, as shown. FIG. 7 shows that a greater initial concentration of NaOCl results in a higher rate of NaOCl decomposition.

FIG. 8 shows the effect of EDTA concentration on the NaOCl decomposition. The data for FIG. 8 were obtained from mixtures of a first liquid, including NaOCl at 5.3 weight percent of the first liquid, and a second liquid, including the EDTA-containing cleaning formulation described above in relation to FIGS. 3–7 with the exception that the amount of EDTA (in weight percent of the second liquid) was varied. The second liquid also included NaOH in the amount of 0.5 weight percent of the second liquid. Upon mixing the first and second liquids, the NaOCl decomposition rate, or reduction of NaOCl concentration (in weight percent of the mixture) over time, for each mixture was determined and plotted, as shown. FIG. 8 shows that a greater initial concentration of EDTA results in a higher rate of NaOCl decomposition, although this effect on the rate of NaOCl decomposition appears to level off for mixtures having high initial EDTA concentrations, such as from about 10 to about 15 weight percent of the second liquid.

FIG. 9 shows the effect of EDTA concentration on the time required for NaOCl decomposition. The data for FIG. 9 were obtained from mixtures of a first liquid and a second liquid, as described above in relation to FIG. 8. The second liquid also included NaOH in the amount of 0.5 weight percent of the second liquid. Upon mixing the first and second liquids, the NaOCl decomposition rate, or reduction of NaOCl concentration (in weight percent of the mixture) over time, for each mixture was determined and plotted, as shown. FIG. 9 shows that a greater initial concentration of EDTA results in a shorter NaOCl decomposition time, as the pH drop occurs earlier.

According to the present invention, when the first and second liquids described in relation to FIGS. 3–9 are initially separated and later admixed during delivery to a surface to be treated, the hypochlorite and the EDTA react, resulting in the decomposition of hypochlorite over a time which is dependent on the amount of NaOH added. Thus, the hypochlorite stability and efficacy for the bleaching of deposits, such as mildew, on a surface, can be effectively controlled. While the hypochlorite and EDTA react, the EDTA does not substantially degrade or oxidize and thus, remains in an amount effective to act on deposits, such as soap scum, on a surface. Therefore, according to the present invention, a composition which includes a hypochlorite oxidizing agent, an EDTA builder and a NaOH pH-adjusting agent is provided for the effective bleaching or cleaning of a surface.

As described above in relation to the inventive apparatus 10 of FIG. 2, the first and second liquids described above may be admixed in an admixing space 30. The admixing space may be volumetrically limited so that only a predetermined volume of the admixture is allowed to exist in the admixing space throughout and after the delivery process. Thus, only the small amount of the admixture in the admixing space may possibly include a compromised oxidizing agent, such as a destabilized or decomposed hypochlorite. According to this embodiment, the apparatus is capable of delivering an effective bleaching or cleaning composition 32 on the first delivery (i.e., initial spray), as this small amount of potentially compromised admixture will be combined with fresh first and second liquids being delivered to the admixing chamber for admixing prior to delivery to the surface to be treated. According to the embodiment of FIG. 1, the apparatus is also capable of delivering an effective bleaching or cleaning composition 32 on the first delivery (i.e., initial spray), as each of the two liquids, either of which may affect the stability or efficacy of the other, are not allowed to interact prior to their admixing, external to the apparatus, during delivery to the surface to be treated.

It is to be understood that while the invention has been described above in conjunction with preferred specific embodiments, the description and examples are intended to illustrate and not to limit the scope of the invention, which is defined by the scope of the appended claims.

It is claimed:

1. An apparatus for surface cleaning, comprising:

a first compartment having a first liquid disposed therein and a second compartment having a second liquid disposed therein, said first and second compartments separating the first and second liquids; and means for spray-delivering the first and second liquids from the first and second compartments, respectively, to a surface external to the apparatus and for forming an admixture of the first and second liquids during delivery to the surface;

wherein the first liquid includes an oxidizing agent selected from a group consisting of a hypohalite and a hypohalite generator, the second liquid includes a builder or a chelating agent, and at least one of the first and second liquids includes a pH-adjusting agent, the pH-adjusting agent in an amount such that upon formation of the admixture, the admixture is maintained at a pH of above about 11.

2. The apparatus of claim 1 wherein the oxidizing agent is selected from a group consisting of an alkali metal hypochlorite, an alkaline earth salt of hypochlorite, and a mixture thereof.

3. The apparatus of claim 1 wherein the oxidizing agent is sodium hypochlorite.

4. The apparatus of claim 1 wherein the oxidizing agent is in an amount between about 0.1 and about 15 weight percent of the first liquid.

5. The apparatus of claim 1 wherein the builder or the chelating agent is selected from a group consisting of a carbonate, a phosphate, a pyrophosphate, an amino carboxylate, a polycarboxylate, a polyacrylate, a phosphonate, an amino phosphonate, a polyphosphonate, a salt thereof, and a mixture thereof.

6. The apparatus of claim 5 wherein the builder or the chelating agent includes ethylenediaminetetraacetic acid or a salt thereof.

7. The apparatus of claim 1 wherein the builder or the chelating agent is in an amount between about 0.1 and about 20 weight percent of the second liquid.

8. The apparatus of claim 1 wherein the pH-adjusting agent is selected from a group consisting of a hydroxide, a hydroxide generator, a buffer, and a mixture thereof.

9. The apparatus of claim 8 wherein the pH-adjusting agent is an alkali metal hydroxide.

10. The apparatus of claim 1 wherein the pH-adjusting agent in present in an amount between about 0.05 and about 10 weight percent relative to the admixture.

11. The apparatus of claim 1 wherein the pH-adjusting agent is present in one of the first and second liquids in an amount between about 0.05 and about 10 weight percent of the one liquid.

12. The apparatus of claim 2 wherein a lifetime of the oxidizing agent in the admixture is above about 5 minutes.

13. The apparatus of claim 12 wherein a lifetime of the oxidizing agent in the admixture is above about 20 minutes.

14. The apparatus of claim 13 wherein the lifetime of the oxidizing agent in the admixture is about 40 minutes.

15. The apparatus of claim 1 wherein at least one of the first and the second liquids includes a fragrance.

16. The apparatus of claim 15 wherein the pH-adjusting agent is in the first liquid and the fragrance is in the second liquid.

17. The apparatus of claim 1 wherein the delivery means comprises a first delivery channel for delivery of the first liquid from the first compartment and a second delivery channel for delivery of the second liquid from the second compartment.

18. The apparatus of claim 17 wherein the delivery means is of a construction sufficient to deliver the first and second liquids contemporaneously and externally with respect to the apparatus, whereupon the liquids meet to form the admixture.

19. The apparatus of claim 17 wherein the delivery means further comprises an admixing space, the first and second delivery channels communicating with the admixing space to deliver the first and second liquids, respectively, thereto, whereupon the liquids form the admixture.

20. The apparatus of claim 19 wherein the admixing space has a capacity for about 1.0 milliliter or less of the admixture.

* * * * *

UNITED STATES PATENT AND TRADEMARK OFFICE

CERTIFICATE OF CORRECTION

PATENT NO. : 5,767,055

DATED : June 16, 1998

INVENTOR(S) : Clement K. Choy et al.

It is certified that error appears in the above-indentified patent and that said Letters Patent is hereby corrected as shown below:

On the title page, item[56],
References Cited, U.S. PATENT DOCUMENTS, Line 15:

| | | | |
|---|---|---|---|
| Replace: | "4,431,558 | 2/1984 | Ulrich" |
| With: | --4,431,559 | 2/1984 | Ulrich-- |

Signed and Sealed this

Twenty-eighth Day of September, 1999

*Attest:*

Q. TODD DICKINSON

*Attesting Officer*

*Acting Commissioner of Patents and Trademarks*